US006042302A

United States Patent [19]

Cook

[11] Patent Number: 6,042,302

[45] Date of Patent: Mar. 28, 2000

[54] DIVE RESCUE SEARCH DEVICE AND METHOD

[76] Inventor: Patrick D. Cook, 7215 Manor Dr., Crystal Lake, Ill. 60014

[21] Appl. No.: 09/182,704

[22] Filed: Oct. 29, 1998

[51] Int. Cl.[7] ..... B63C 11/02

[52] U.S. Cl. ..... 405/186; 405/185; 405/188

[58] Field of Search ..... 405/185, 186, 405/191–194, 188, 195.1, 189, 190; 114/315, 312

[56] References Cited

U.S. PATENT DOCUMENTS

| | | | |
|---|---|---|---|
| 404,390 | 6/1889 | Dutton | 405/185 X |
| 1,238,952 | 9/1917 | Stelzner | 405/186 |
| 1,423,923 | 7/1922 | Eckert | 405/186 X |
| 1,733,102 | 10/1929 | Rohmer . | |
| 2,684,109 | 7/1954 | Youmans . | |
| 2,918,280 | 12/1959 | Torbett et al. . | |
| 3,464,217 | 9/1969 | Streit | 405/185 |
| 4,157,229 | 6/1979 | Kumm | 405/185 |
| 5,036,613 | 8/1991 | Smith . | |
| 5,280,921 | 1/1994 | Milburn . | |

*Primary Examiner*—Dennis L. Taylor
*Attorney, Agent, or Firm*—Mathew R. P. Perrone, Jr.

[57] ABSTRACT

A dive rescue search device has a stanchion with a locating mechanism for the device, a marking device to assist the diver and a search area marker to properly direct the search.

20 Claims, 4 Drawing Sheets

DIVE RESCUE SEARCH DEVICE AND METHOD

This invention relates to a search and rescue device more particularly to a dive rescue search device designed to define the search area and a method for searching.

BACKGROUND OF THE INVENTION

One of the primary functions, above and beyond the traditional fire fighting duties, of a fire department these days is search and rescue. In particular, the burden of doing underwater search or rescue usually falls to the fire department. For this purpose, fire departments need to have scuba divers.

A scuba diver is a highly-skilled person. These skills are well-used in search and rescue operations. To maximize the use of those skills, it is necessary to provide equipment to assist search procedures. The equipment must also be easy to use and to recover.

Such underwater rescues are very difficult procedures to complete. Accordingly, even though these matters are difficult to complete, it is highly desirable to do so in an efficient and thorough fashion so that the rescue, if possible, may be completed as quickly as possible. Speed of search is usually synonymous with a successful rescue.

Also, it is common for criminals to dispose of evidence underwater. Typical examples of underwater disposal elements include, but are not limited to, weapons, physical evidence from a crime scene, or other material. Such disposal of material in bodies of water is done, of course, in hopes that it will never be found. An efficient, underwater, search mechanism can create the greatest opportunity for recovery of the evidence.

It is very difficult to provide a mechanism, which can mark off a search area or search quadrant, so that the diver can be sure of the area, which has been searched. This is especially true in case of murky or unclear water. Such murky or unclear water is very common in the Midwestern United States.

The lakes and ponds and rivers common to the area are rarely enough for an unassisted search, by a scuba diver. Some efficient marking for the search area is required. Such a device or method can greatly add to search efficiency.

If the diver fails to search an area, it is a problem. If a diver searches the same area twice, unintentionally, it is a problem. Both of these problems add time to rescue or recovery. Solving these problems will greatly increase search efficiency.

It is desirable also to recover the rescue device. yet when such a device is deployed in water, it can be difficult to recover the same. If recovery of the search device can be provided in a more efficient manner, the use of the search device is still more efficient.

Various devices exist for assisting this search. However, it is complicated to use these devices on many occasions. It a device can be designed so that the search can be conducted simply, without backtracking over the same area while at the same time conducting an efficient search, great advantages can be obtained. The time used by the skilled diver is more effective, with a more clear marking out of the search area.

SUMMARY OF THE INVENTION

Among the many objectives of this invention is the provision of a dive rescue search device, capable of clearly defining the area searched.

A further objective of this invention is the provision of a dive rescue search device, with a stanchion.

A still further objective of this invention is the provision of a dive rescue search device, with a clear marking device for the search area.

Yet a further objective of this invention is the provision of a dive rescue search device, with an efficient recovery device.

Also an objective of this invention is the provision of a dive rescue search device, with an efficient deployment mechanism.

Another objective of this invention is the provision of a dive rescue search device, with a search area marker.

Still another objective of this invention is the provision of a dive rescue search device, with a clear diver marking area.

Yet another objective of this invention is the provision of a dive rescue search device, with an efficient positioning mechanism.

A further objective of this invention is the provision of a method for performing an efficient dive rescue search.

These and other objectives of the invention (which other objectives become clear by consideration of the specification, claims and drawings as a whole) are met by providing a dive rescue search device, having a stanchion with a locating mechanism for the device, a marking device to assist the diver and a search area marker to properly direct the search.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
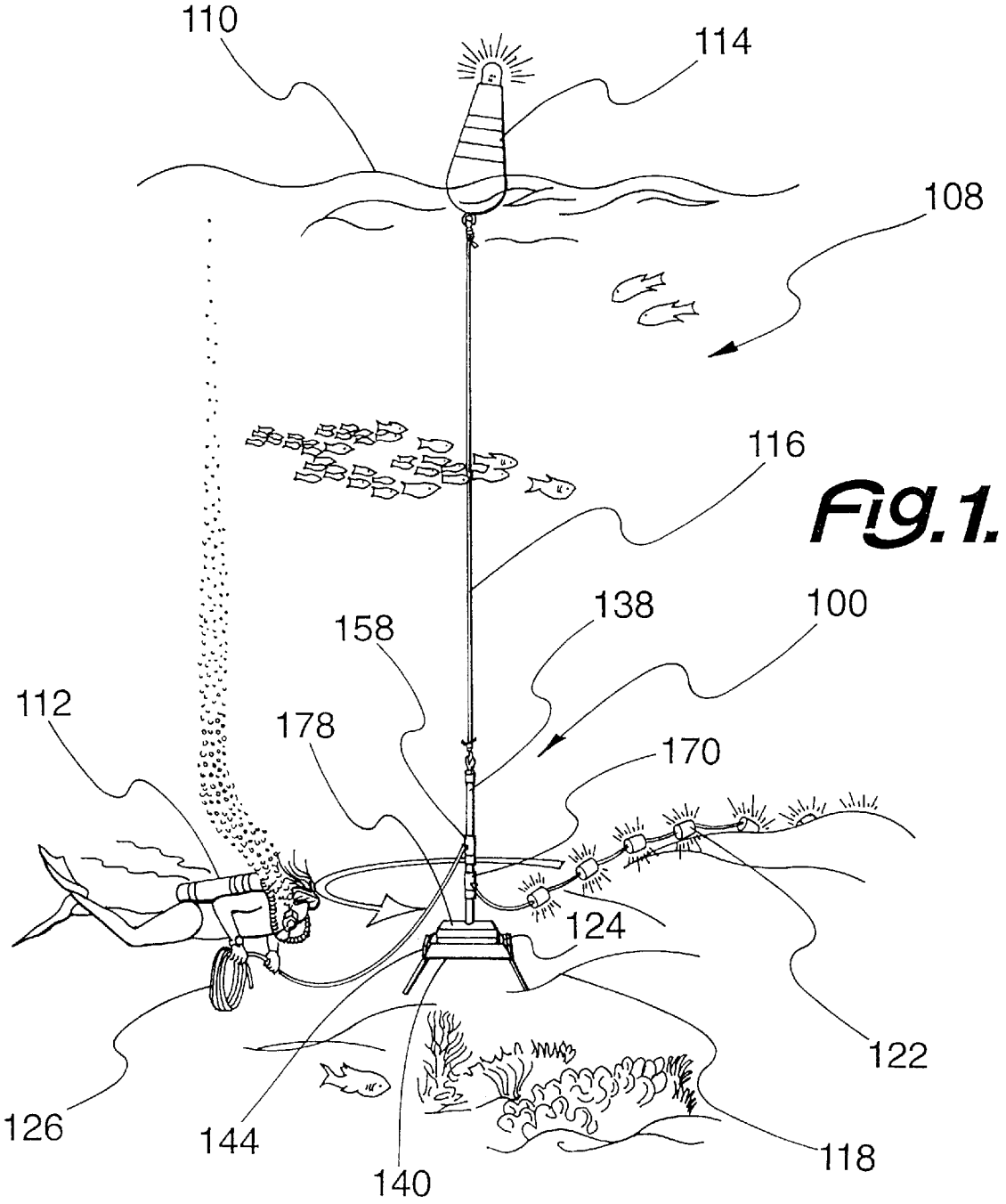
FIG. 1 depicts a perspective view of the dive rescue search device 100 of this invention in use.

The dive rescue search device of this invention includes a stanchion with various implements secured thereto. The stanchion includes a base with four legs. Extending upwardly from the base is a stanchion tube. Mounted on the stanchion tube, are two swivel members. To the top of the stanchion tube is secured a buoy, which indicates the location of the stand and, more importantly, the position of the diver.

One swivel member is mounted on the stanchion tube and adjacent to the base. The second swivel member is mounted on the stanchion tube above the first swivel member. To the first or lower swivel member mounted adjacent to the base is attached a string of lights. To the second or upper swivel member is attached the payout line.

With the string of lights in position, by extending the string of lights from the stanchion tube, the diver may determine the area of search by comparing the position of each light on the string with the payout line. Each light in the string may include a position indicator. Such indicator for light position on the string may be by light color or number, or other suitable method.

A preferred light string is a weighted string of battery powered strobe lights. These strobe lights are highly effective in murky water, because they more easily attract the diver's attention. The weight keeps the string in position on the bottom. The weight can be in the string or line to which lights are attached.

Each strobe light has its own housing. This light housing supports the light and provides the string fastener for attaching the lights to the string or line to form the light string. The housing may also be weighted to assist in light positioning for a search.

Substantially similar in length to the string of lights is the payout line. The payout line may be a rope or other flexible elongated member. The diver will hold the payout line and use it as a guide to circle the stanchion tube. Each time the string of lights is passed, the payout line is adjusted to expand or decrease the search area. In this fashion, it can be determined, where the search has been conducted, where the stand has been placed, and where the diver has searched.

The base for the dive search rescue device includes a platform supported by three or more legs. Four legs provide the most effective support for the platform in the underwater environment. The platform is preferably square or rectangular in shape, with upwardly turned flanges at the edge thereof.

Due to shape of the platform, at least one weighted member may be added to the platform. Usually the weighted member has an aperture adapted to receive the stanchion tube. With a square or rectangular shape, the weight may held in position by the flanges. The weight members assist in the positioning of the dive search rescue device, by overcoming the buoyancy of the water.

Alternatively, one or more standard lead diver weights may be used. This standard lead diver weight is readily available, weighs about 4.5 kilograms (10 pounds), and has dimensions of about 2.5 centimeters (one inch) by 25.4 centimeters (10 inches) by 7.6 centimeters (three inches) such weights may be placed on the platform. Such standard weights may be simply placed on platform and held there by their own weight. Tape may also secure standard weight or weights in position. Other securing devices may be used for the weight or series of weights also.

Such removable weights permit the device to be disassembled easily and stored. The dive search rescue device can also be reassembled quickly when use is desired. This flexibility of use and storage makes this device extremely useful.

In FIG. 1, the dive search rescue device 100 is depicted as in use. The diver 112 is secured to the dive search rescue device 100 by payout line 126. The device 100 includes a weighted base 140 and a stanchion tube 138. The stanchion tube 138 is connected to a buoy line 116. A lighted buoy 114 is at the opposing end of the buoy line 116 and oppositely disposed from the stanchion tube 138. In this fashion, the buoy 114 can appear on the surface 110 of the water 108 while making the position of the search device 100 well known.

On the stanchion tube 138 is mounted an upper swivel member 158 and a lower swivel member 170. To the upper swivel member 158 is attached a payout line 126 for the diver 112 to use. To the lower swivel member 170 is attached a string of weighted lights 122. The payout line 126 cooperates with the weighted light string 122, to give the scuba diver 112 an idea of search area and position.

The weighted lights 122 are strung out in a distance from the stanchion tube 138. The base 140 has platform 124 with turned up flanges 144 at each edge thereof. A formed lead weight 178 slides over the stanchion tube 138 down to the platform 124.

The diver 112 attaches the payout line 126 line to the upper swivel member 158 above the weighted device of strobe lights 122. The diver 112 can then use the payout line 126 and pass the weighted strobe lights 122 as the search of the sea floor 118 is conducted. The strobe lights 122 and the payout line 126 combine to define the position that has been searched and locate the area that still needs to be searched.

Figure 2:
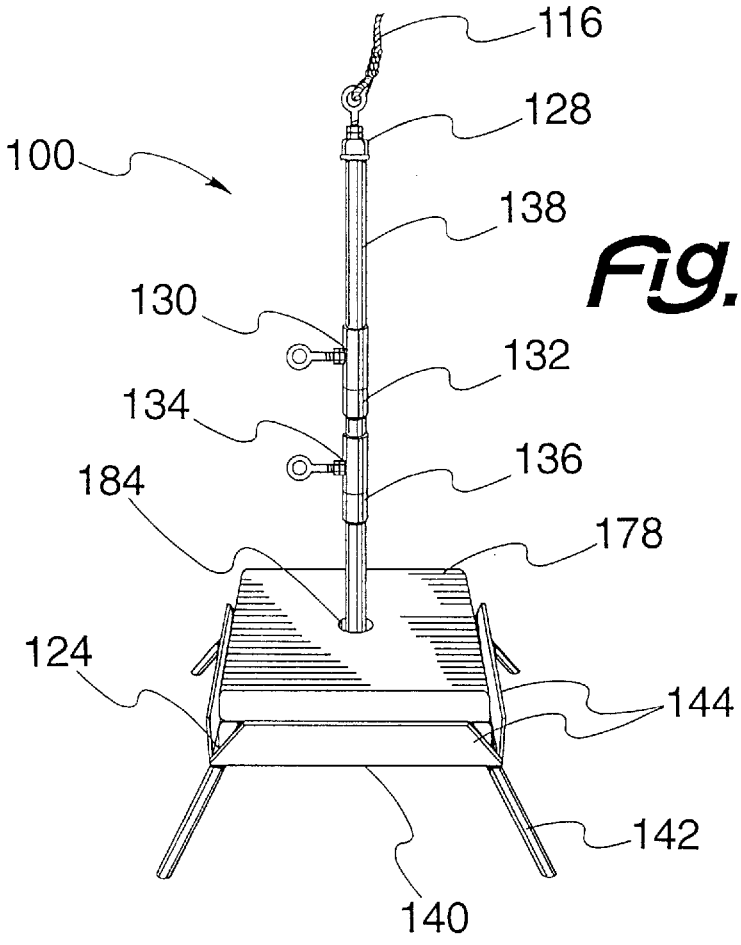
FIG. 2 depicts a perspective view of the support stanchion 120 for the dive rescue search device 100 of this invention.
Figure 4:
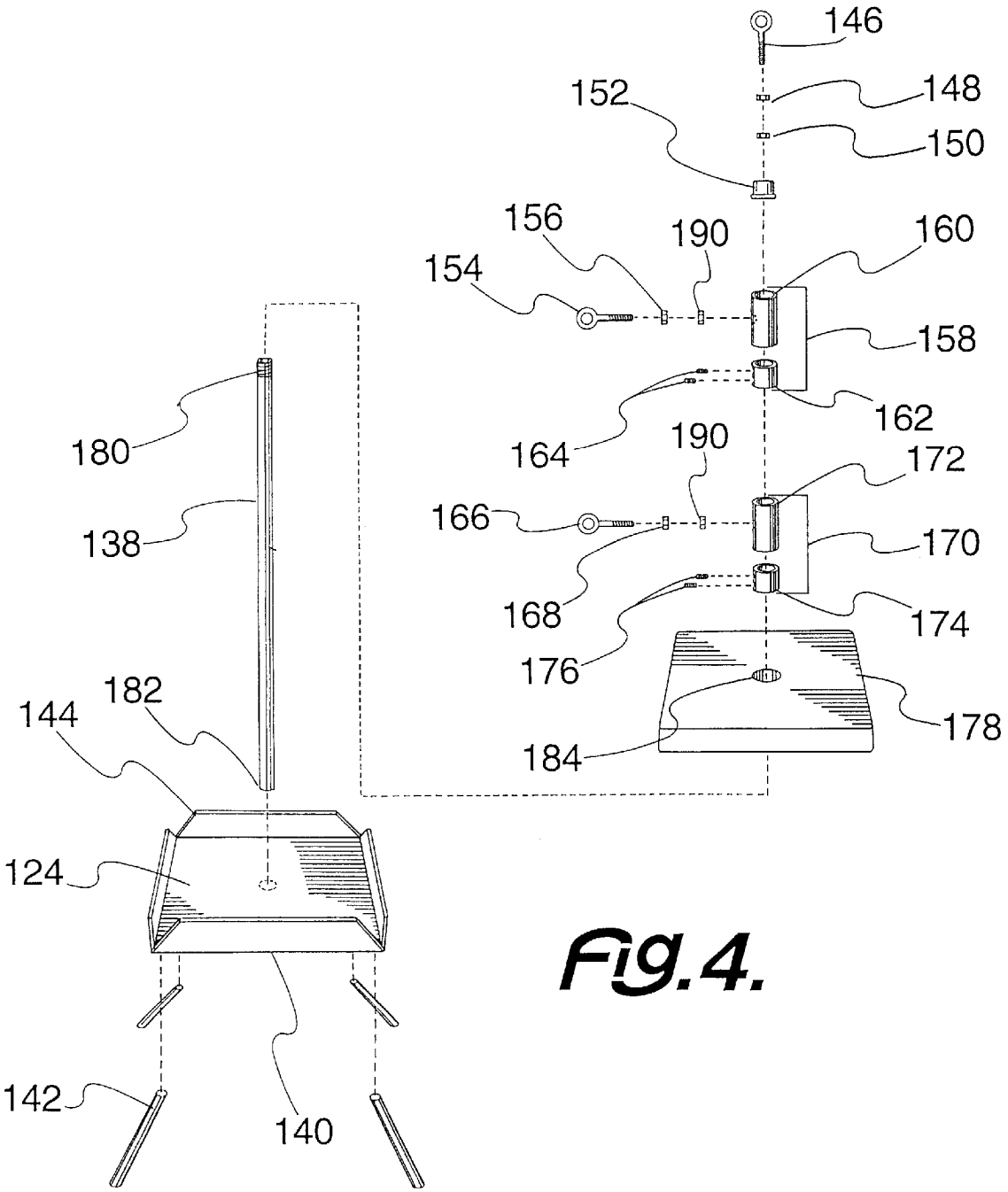
FIG. 4 depicts an exploded, perspective view of the support stanchion 120 for the dive rescue search device 100 of this invention.

Referring now to FIG. 2 and FIG. 4, on the stanchion tube 138, is mounted an end cap tether assembly 128. The end cap tether assembly 128 receives the buoy line 116. The upper swivel tether assembly 130 has an upper swivel adjustable base 132. The lower swivel tethered assembly 134 has a lower swivel adjustable base 136.

Flanges 144 around platform 124 prohibit the formed lead weight 178 from rotating, because formed lead weight 178 has a shape similar to shape of the platform 124, formed by flanges 144. The formed lead weight 178 for the base 140 of the dive search rescue device 100 overcomes the buoyancy of the device 100. Platform 124 may of itself have sufficient weight, but removable weights provide for easier transportation and use of device 100. Centrally located in the formed lead weight 178 is an aperture 184 of sufficient size to permit formed lead weight 178 to slide over stanchion tube 138, and onto platform 124.

The base 140 of the device 100 includes at least three legs 142, or preferably four legs 142. Legs 142 are preferably at the corner of the platform 124 of the base 140. Legs 142 may be secured to platform 124 by welding, bolting or another suitable mechanism. This device 100 thus has stability in the positioning of the device 100 on the sea floor 118.

Any number of formed lead weights 178 may be inserted over the stanchion tube 138 in order to permit the base 140 to be properly supported and positioned on the sea floor 118, of the body of water 108 being searched. In this fashion buoyancy may be overcome.

The end cap tether assembly 128 includes a first eye bolt 146, a top lock nut 148, and a top weld nut 150. The top lock nut 148 and the top weld nut 150 fit into top upper eye bolt 146 and on end cap 152. End cap 152 fits on the threaded tube end 180 of the stanchion tube 138.

The stanchion tube 138 has a base end 182 welded or otherwise secured to the central portion of the base 140. Base end 182 of stanchion tube 138 may be also screwed, welded or otherwise secured to base 140. Legs 142 are welded or otherwise secured to the base 140. A desirable number of formed lead weights 178 or other weighted accessory are slidable mounted or otherwise secured over the stanchion tube 138.

The adjustable height base sleeve 174 is secured in place buy one or more of base set screw 176. The position of the strobe lights 122 is thus locked or otherwise marked on the stanchion tube 138, thereby. The lower eye bolt 166 and lower lock nut 168 along with the weld nut 190 secures the lower eye bolt 166 into lower swivel sleeve 172 of the lower swivel tether assembly 134. In this fashion, the strobe lights 122 may be more efficiently attached.

In a like fashion, the upper swivel assembly 132 includes an upper swivel sleeve 160, an adjustable upper sleeve 162, with upper set screws 164 securing the upper sleeve 162 to stanchion tube 138 thereto. At the same time, upper eye bolt 154 and upper lock nut 156 permit the upper eye bolt 154 to be properly locked to the upper swivel sleeve 160 as desired. Weld nut 190 is also used in the upper swivel assembly 130 and lower swivel assembly 134.

Figure 3:
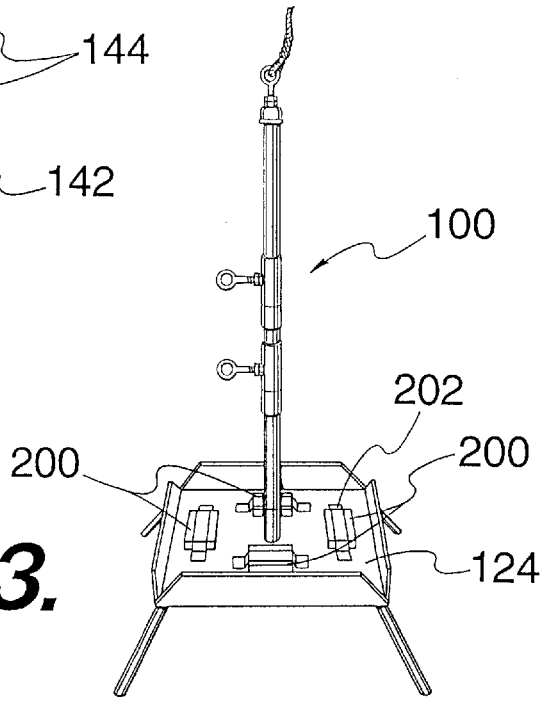
FIG. 3 depicts a perspective view of the free lead weight assembly 200 the dive rescue search device 100 of this invention.

As shown in FIG. 3, formed lead weight 178 is replaced by the standard lead diver weight 200. Such a standard lead diver weight 200 may be simply placed on platform 124 and held there by their own weight. Tape 202 may also secure weight or weights 200 in position.

Figure 5:
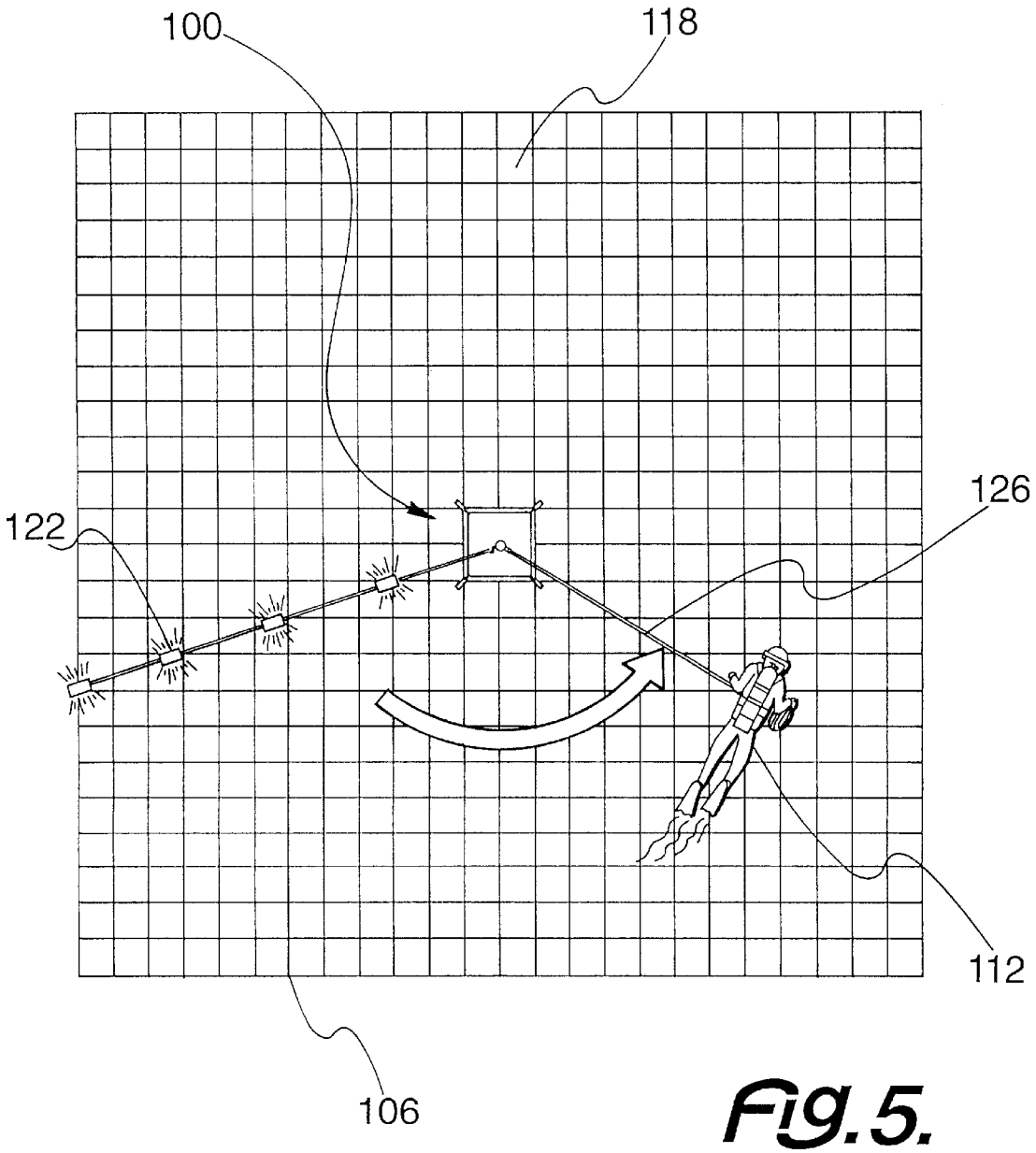
FIG. 5 depicts a top plan view of the dive rescue search device 100 of this invention, in use.

In FIG. 5, a top view of the sea floor 118 is depicted. With the diver 112, and the consistent use of payout line 126 combined with the strobe lights 122, a grid 106 on the sea floor 118 can be very efficiently searched.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A dive rescue search device comprising:

(a) a stanchion being combined with a locating mechanism for the device, a marking device adapted to assist a diver and a search area marker;

(b) the stanchion including a platform base;

(c) a stanchion tube extending upwardly from the platform base;

(d) the stanchion tube having a first tube end adjacent to the platform base;

(e) the stanchion tube having a second tube end oppositely disposed from the first end;

(f) the stanchion tube having a marking means mounted thereon and a guide means mounted thereon;

(g) the marking means serving to mark an area for a search; and (h) the guide means serving to guide the diver on the search.

2. The dive rescue search device of claim 1 further comprising:

(a) the marking means including a marking swivel member;

(b) the guide means including a guide swivel member;

(c) the marking means including a marking device attached to the marking swivel member; and (d) the guide means including a guide device attached to the guide swivel member.

3. The dive rescue search device of claim 2 further comprising:

(a) the second end having a device locating means secured thereto; and (b) the second end having a device locating means secured thereto.

4. The dive rescue search device of claim 3 further comprising:

(a) the marking device being a string of lights;

(b) the guide device being a rope adapted to indicate a variable position for the diver;

(c) a weight member being mounted on the platform in order to stabilize the dive rescue search device.

5. The dive rescue search device of claim 4 further comprising:

(a) the second tube end having a buoy line secured thereto at a first line end;

(b) the buoy line having second line end oppositely disposed from the first line end;

(c) the second line end having a floating member secured; and (d) the floating member secured being adapted to provide a location indicator for the dive rescue device as the dive rescue device is being used.

6. The dive rescue search device of claim 5 further comprising:

(a) the string of lights further including a position indicator adapted to cooperate with the rope; and (b) the string of lights having a length adapted to cooperate with the rope.

7. The dive rescue search device of claim 6 further comprising:

(a) the position indicator being at one least one positioning member selected from the group consisting of a colored light, a numbered light, and a strobe light; and (b) the position indicator being weighted.

8. The dive rescue search device of claim 7 further comprising:

(a) the positioning member being at least one self-contained light and housing; and (b) the self-contained light and housing including a weighted light means and a line fastening means to provide for attachment in order to form the string of lights.

9. The dive rescue search device of claim 7 further comprising:

(a) the platform base including a weight support platform;

(b) the weight support platform being supported by least three legs; and (c) the weight support platform providing a stable weight for the dive rescue search device in order permit a stable submerged position therefor.

10. The dive rescue search device of claim 9 further comprising:

(a) the platform base including an upwardly turned flange for each edge of the weight support platform; and (b) the upwardly turned flange serving to position at least one weight element on the platform base.

11. The dive rescue search device of claim 10 further comprising:

(a) the platform base having four legs in order to provide most effective support for the platform base in an underwater environment; and (b) the platform being rectangular in shape.

12. The dive rescue search device of claim 11 further comprising:

(a) a buoy line having a first line end secured to the second tube end;

(b) the buoy line having a second line end oppositely disposed from the first line end;

(c) a floating marker being secured to the second line end; and (d) the buoy line being of sufficient length to permit the marker to float on a surface of a body of water.

13. The dive rescue search device of claim 12 further comprising:

(a) a marked fastening means removably securing the marking swivel member at a desired mark position on the stanchion tube; and (b) a guide fastening means removably securing the guide swivel member at a desired guide position on the stanchion tube.

14. A dive rescue search device comprising:

(a) a stanchion being combined a locating mechanism for the device, a marking device adapted to assist a diver and a search area marker;

(b) the stanchion including a platform base;

(c) a stanchion tube extending upwardly from the platform base;

(d) the stanchion tube having a first tube end adjacent to the platform base;

(e) the stanchion tube having a second tube end oppositely disposed from the first end;

(f) the stanchion tube having a marking means mounted thereon and a guide means mounted thereon;

(g) the marking means serving to mark an area for a search;

(h) the guide means serving to guide the diver on the search;

(i) the marking means including a marking swivel member;

(j) the guide means including a guide swivel member;

(k) the marking means including a marking device attached to the marking swivel member;

(l) the guide means including a guide device attached to the guide swivel member;

(m) the second end having a device locating means secured thereto; and (n) the device locating means being adapted to float on a surface of a body of water.

15. The dive rescue search device of claim 14 further comprising:

(a) the marking device being a string of lights;

(b) the guide device being a rope adapted to indicate a variable position for the diver;

(c) a weight member being mounted on the platform in order to stabilize the dive rescue search device;

(d) the second tube end having a buoy line secured thereto at a first line end;

(e) the buoy line having a second line end oppositely disposed from the first line end;

(f) the second line end having a floating member secured;

(g) the floating member secured being adapted to provide a location indicator for the dive rescue device as the dive rescue device is being used; and (h) the string of lights further including a position indicator adapted to cooperate with the rope.

16. The dive rescue search device of claim 15 further comprising:

(a) the string of lights having a length adapted to cooperate with the rope;

(b) the position indicator being at one least one positioning member selected from the group consisting of a colored light, a numbered light, and a strobe light;

(c) the position indicator being weighted;

(d) the positioning member being at least one self-contained light and housing;

(e) the self-contained light and housing including a weighted light means and a line fastening means to provide for attachment in order to form the string of lights;

(f) the platform base including a weight support platform supported;

(g) the weight support platform being supported by least four legs;

(h) the weight support platform providing a stable weight for the dive rescue search device in order permit a stable submerged position therefor; and (i) the platform base including an upwardly turned flange for each edge of the weight support platform.

17. The dive rescue search device of claim 16 further comprising:

(a) the upwardly turned flange serving to position at least one weight element on the platform base;

(b) the platform base having four legs in order to provide most effective support for the platform base in an underwater environment;

(c) the platform being rectangular in shape;

(d) a buoy line having a first line end secured to the second tube end;

(e) the buoy line having a second line end oppositely disposed from the first line end;

(f) a floating marker being secured to the second line end;

(g) the buoy line being of sufficient length to permit the marker to float on a surface of a body of water (h) a marked fastening means removably securing the marking swivel member at a desired mark position on the stanchion tube; and (i) a guide fastening means removably securing the guide swivel member at a desired guide position on the stanchion tube.

18. A method for conducting an underwater search and rescue operation comprising:

(a) providing a central location underwater;

(b) extending a series of lights from the central location as a first guide in order to provide a fixed position designation series;

(c) providing an extendible second guide from the central location;

(d) rotating the extendible second guide around the central location;

(e) determining a position from the fixed position designation series with the second guide; and (f) using the second guide in combination with the first guide in order from the central location.

19. The method of claim 18 further comprising:

(a) providing an above water marker from the central location;

(b) providing an identification means for each member of the series of lights; and (c) comparing the identification with the extendible member.

20. The method of claim 19 further comprising the above water marker being a buoy secured to the central location.

* * * * *